United States Patent [19]

Hirai et al.

[11] Patent Number: 4,775,613

[45] **Date of Patent: * Oct. 4, 1988**

[54] HEAT-DEVELOPABLE LIGHT-SENSITIVE MATERIAL

[75] Inventors: Hiroyuki Hirai; Hiroshi Hara; Ken Kawata, all of Kanagawa, Japan

[73] Assignee: Fuji Photo Film Co., Ltd., Kanagawa, Japan

[ * ] Notice: The portion of the term of this patent subsequent to Dec. 16, 2003 has been disclaimed.

[21] Appl. No.: 846,449

[22] Filed: Mar. 31, 1986

[30] Foreign Application Priority Data

Mar. 30, 1985 [JP] Japan ..... 60-67308
Apr. 26, 1985 [JP] Japan ..... 60-90089

[51] Int. Cl.[4] ..... G03C 1/06; G03C 7/26; G03C 7/32

[52] U.S. Cl. ..... 430/505; 430/619; 430/620; 430/543; 430/559; 430/562; 430/203; 430/351; 430/353

[58] Field of Search ..... 430/620, 619, 543, 559, 430/562, 505, 203, 351, 353

[56] References Cited

U.S. PATENT DOCUMENTS

| | | | |
|---|---|---|---|
| 4,535,056 | 8/1985 | Frenchik | 430/620 |
| 4,584,267 | 4/1986 | Masukawa et al. | 430/620 |
| 4,603,103 | 7/1986 | Hirai et al. | 430/617 |
| 4,610,957 | 9/1986 | Kato et al. | 430/620 |
| 4,629,684 | 12/1986 | Sato et al. | 430/619 |

*Primary Examiner*—Won H. Louie
*Attorney, Agent, or Firm*—Sughrue, Mion, Zinn, Macpeak, and Seas

[57] ABSTRACT

A heat-developable light-sensitive material comprising a support having thereon at least one layer containing a light-sensitive silver halide, a reducing agent, a binder and an acetylene silver compound.

The heat-developable light-sensitive material which contains the novel organic silver compound can provide images having high density and low fog when subjected to a short period of developing time even when a small amount of a base processor is used.

21 Claims, No Drawings

HEAT-DEVELOPABLE LIGHT-SENSITIVE MATERIAL

FIELD OF THE INVENTION

The present invention relates to a heat-developable light-sensitive material containing a novel organic silver compound.

BACKGROUND OF THE INVENTION

Heat-developable photographic light-sensitive materials and methods for forming images using the materials are well known and are described in detail, for example, in *Shashin Kogaku no Kiso* (Fundamentals of Photographic Engineering), Corona Co., Ltd., pp. 553 to 555 (1979), *Eizo Joho* (Image Information) (April, 1978), pp. 40, and *Neblett's Handbook of Photography and Reprography*, 7th Ed., Van Nostrand Reinhold Company, pp. 32 to 33 (1977), etc.

Typical examples of organic silver compounds which can be used in heat-developable light-sensitive materials include silver salts of aliphatic carboxylic acids and silver salts of aromatic carboxylic acids.

Further examples include silver salts of aliphtic carboxylic acids having a thioether group as described in U.S. Pat. No. 3,330,663.

However, these silver salts of carboxylic acids are disadvantageous in that they release acids after reacting with reducing agents to reduce the pH in the layer and thus subsequent development is restrained.

Organic silver salts other than silver salts of carboxylic acids include silver salts of compounds having a mercapto group, or a thione group, and derivatives thereof.

Additional examples include silver salts of compounds having an imino group such as silver salts of benzotriazole or derivatives thereof, etc., as described in Japanese Patent Publication Nos. 30270/69 and 18416/70.

However, these silver salts are disadvantageous in that they release a compound which restrains development, or, in some cases, causes fog after reacting with reducing agents. Furthermore, they sometimes inhibit the functions of spectral sensitizing dyes, and high sensitivity cannot be obtained.

Moreover, into heat-developable light-sensitive materials, bases or base precursors are frequently incorporated for the purpose of accelerating development by heat. In view of preservability of the light-sensitive materials, it is particularly preferred to employ base precursors which release basic substances upon thermal decomposition. In such cases, as the amount of the base precursor incorporated into the light-sensitive material is increased, development is accelerated. It is, however, accompanied with undesirable side-effects such as an increase of fog and inhibition of the functions of spectral sensitizing dyes, etc. Therefore, it is desired to employ the base precursor in an amount as small as possible.

In such circumstances, it has been desired to provide a highly active organic silver compound which can form images having high density even when only a small amount of a base precursor is employed.

SUMMARY OF THE INVENTION

Therefore, an object of the present invention is to provide a heat-developable light-sensitive material which forms an image having high density and low fog upon a short period of developing time even when a small amount of a bse precursor is employed, and which does not show any adverse side-effect at heat-development.

Other objects of the present invention will become apparent from the following detailed description and examples.

These objects of the present invention are accomplished with a heat-developable light-sensitive material comprising a support having thereon at least a light-sensitive silver halide, a reducing agent, a binder, and an acetylene silver compound.

DETAILED DESCRIPTION OF THE INVENTION

The heat-developable light-sensitive material of the present invention is characterized by containing the acetylene silver compound.

The preferable acetylene silver compound is one having at least one —C≡CAg group, and more preferable acetylene silver compound is represented by formula (I)

$$R—C≡CAg \qquad (I)$$

wherein R represents a substituted or unsubstituted alkyl group, a substituted or unsubstituted cycloalkyl group, a substituted or unsubstituted alkenyl group, a substituted or unsubstituted alkynyl group, a substituted or unsubstituted aralkyl group, a substituted or unsubstituted aryl group, or a substituted or unsubstituted heterocyclic group.

The alkyl group represented by R may be a straight chain or branched chain alkyl group, including, for example, a butyl group, an iso-butyl group, a cyclohexyl group, a heptyl group, an octyl group, a dodecyl group, etc. Examples of substituents for the substituted alkyl group include an alkoxy group (for example, a methoxy group, etc.), a hydroxy group, a cyano group, a halogen atom, a sulfonamido group, a substituted or unsubstituted alkynyl group (for example, an ethynyl group, a silver ethynyl group, etc.), etc. and examples of substituents for the substituted cycloalkyl group include a hydroxy group, etc.

Examples of the cycloalkyl group represented by R include a cyclopentyl group, a cyclohexyl group, and a decahydronaphthyl group, etc.

Examples of the alkenyl group represented by R include a propenyl group, an iso-propenyl group, a styryl group, etc.

Examples of the alkynyl group represented by R include an ethynyl group, a phenylethynyl group, etc.

Examples of the aryl group represented by R include a phenyl group, a naphthyl group, an anthryl group, etc. Examples of substituents for the substituted aryl group include an alkyl group (for example, a methyl group, a dodecyl group, etc.), a cyano group, a nitro group, an amino group, an acylamino group, such as

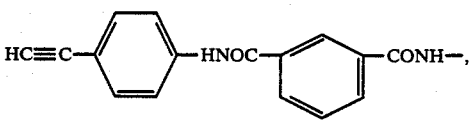

-continued

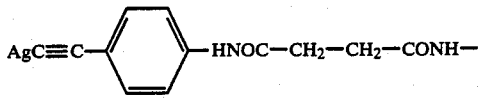

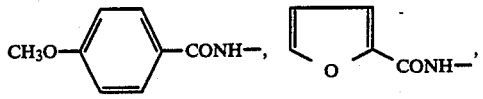

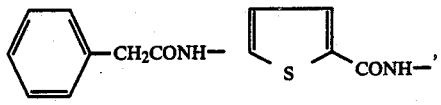

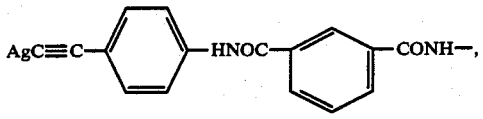

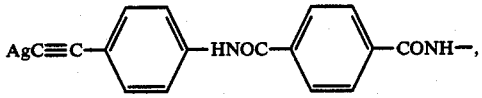

etc., a sulfonamido group (including an aliphatic, aromatic or heterocyclic sulfonamido group), an alkoxy group, an aryloxy group, an alkoxycarbonyl group, a ureido group, a carbamoyl group, an acyloxy group, a heterocyclic group (including a 5-membered or 6-membered heterocyclic group, and preferably a nitrogen-containing heterocyclic group), an alkylsulfonyl group, a carboxylic acid group, a sulfonic acid group, a sulfamoyl group, such as $(CH_3)_2NSO_2$—,

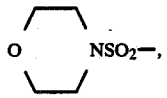

etc., a sulfamoyl amino group, a halogen atom (for example, a fluorine atom, a bromine atom, a chlorine atom, an iodine atom), a substituted or unsubstituted alkynyl group (for example, an ethynyl group, a silver ethynyl group, etc.), etc. These substituents may be further substituted. Further, two or more of the above-described substituents may be present. Moreover, the foregoing substituents may also be substituents on the groups described below.

Examples of the aralkyl group represented by R include a benzyl group, a phenethyl group, etc.

The heterocyclic group represented by R is preferably a 5-membered or 6-membered heterocyclic group including as a hetero atom at least one of a nitrogen atom, an oxygen atom, and a sulfur atom. Examples of the heterocyclic group include a furan ring residue, a thiophen ring residue, a pyridine ring residue, a quinoline ring residue, an isoquinoline ring residue, a thiazole ring residue, and a benzothiazole ring residue, carbazole ring residue etc.

As described above, the heterocyclic group may be a monocyclic group or a condensed ring group, and may be substituted. Examples of substituents for the substituted heterocyclic group include an alkoxy group, a cyano group, a halogen atom, a carbamoyl group, a sulfamoyl group, and a substituted or unsubstituted alkynyl group (for example, an ethynyl group, a silver ethynyl group, etc.), etc.

In the compound represented by formula (I), a bond between the acetylene compound and silver may be either a sigma ($\sigma$) bond or a pi ($\pi$) bond.

Of the acetylene silver compounds according to the present invention, those represented by formula (I) wherein R represents a phenyl group or a substituted phenyl group are preferred.

Specific examples of the acetylene silver compounds according to the present invention are set forth below, but the present invention should not be construed as being limited thereto.

(1)

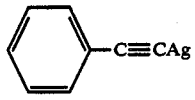

(2)

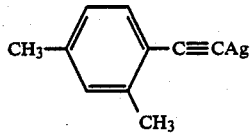

(3)

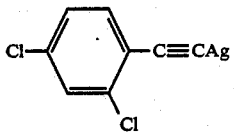

(4)

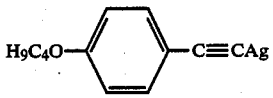

(5)

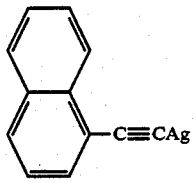

(6)

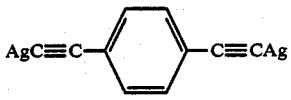

(7)

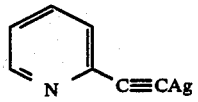

(8)

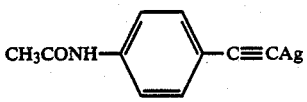

(9)

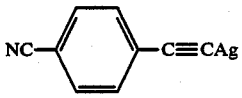

(10)

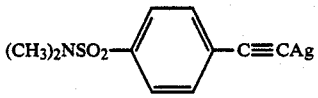

-continued
(11)
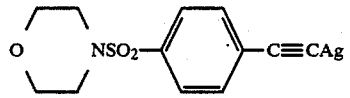
(12)
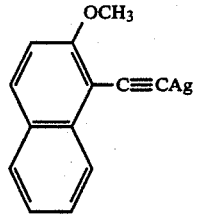
(13)
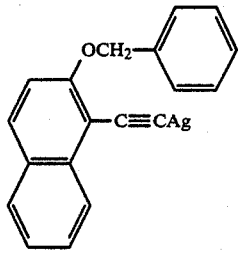
(14)
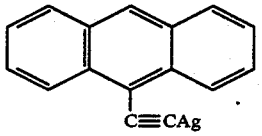
(15)
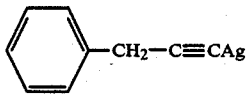
(16)
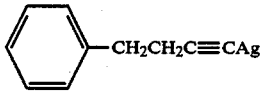
(17)
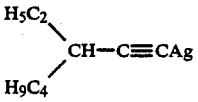
(18)
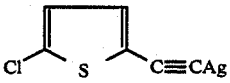
(19)
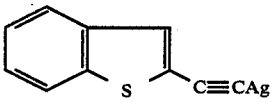
(20)
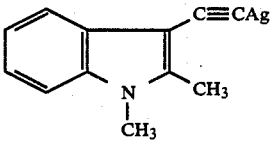
-continued
(21)
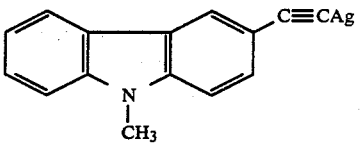
(22)
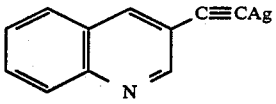
(23)
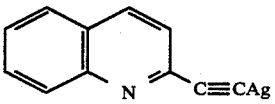
(24)
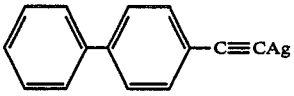
(25)
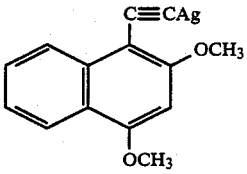
(26)
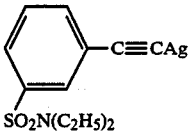
(27)
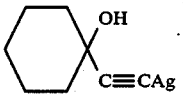
(28)
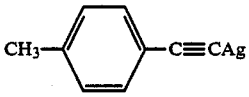
(29)
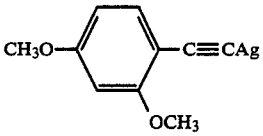
(30)
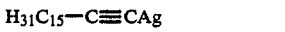
(31)
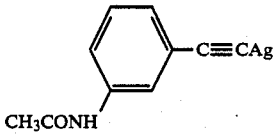
(32)
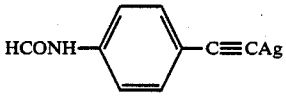

-continued
(33)
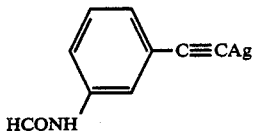
(34)
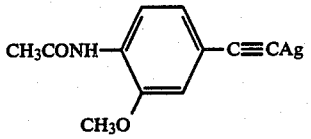
(35)
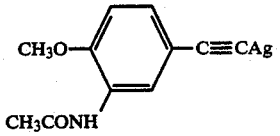
(36)
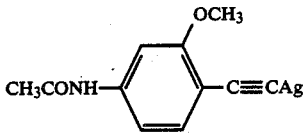
(37)
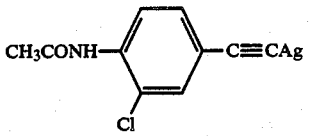
(38)
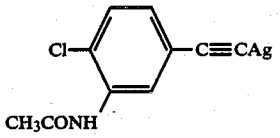
(39)
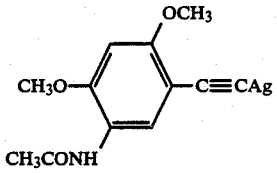
(40)
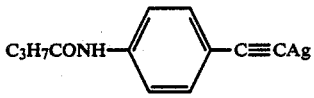
(41)
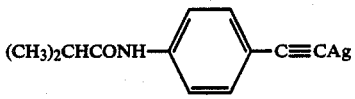
(42)
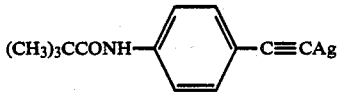
(43)
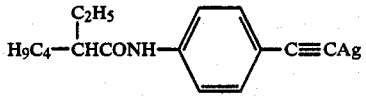
-continued
(44)
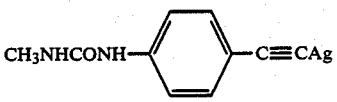
(45)
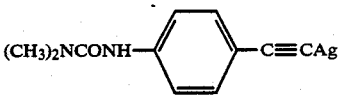
(46)
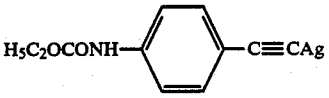
(47)
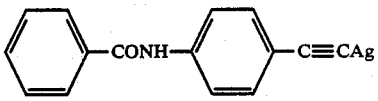
(48)
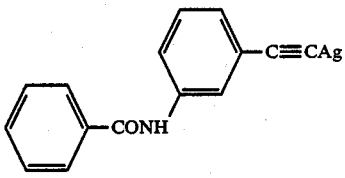
(49)
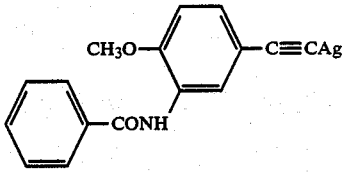
(50)
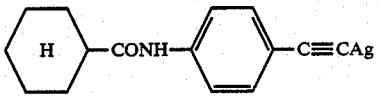
(51)
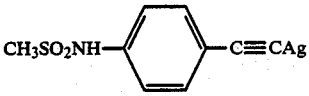
(52)
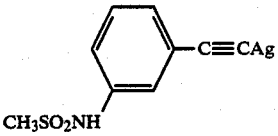
(53)
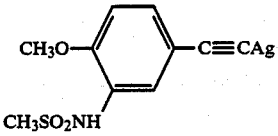
(54)
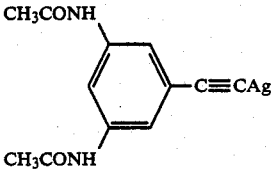

-continued (55)

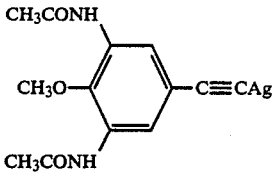

(56)

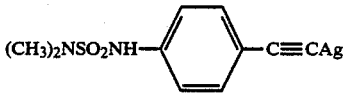

(57)

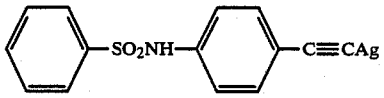

(58)

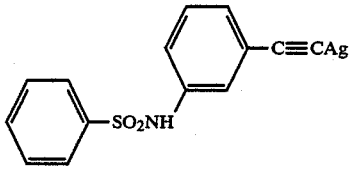

(59)

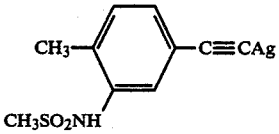

(60)

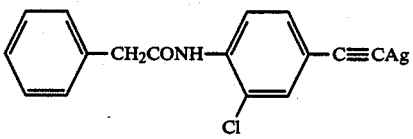

(61)

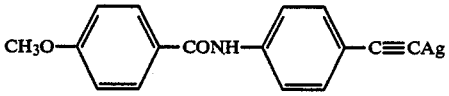

(62)

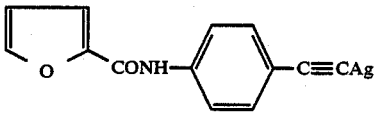

(63)

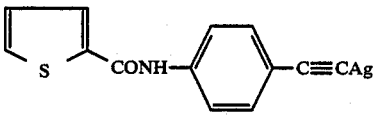

(64)

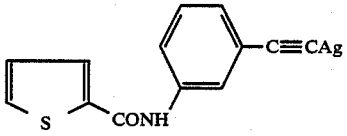

(65)

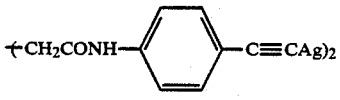

-continued (66)

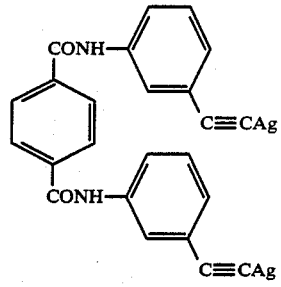

(67)

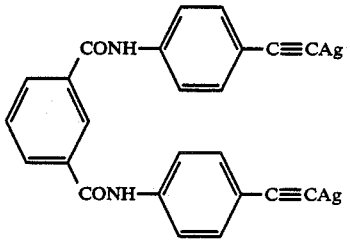

(68)

$CH_3O-CH_2-CH_2-OCH_2C\equiv CAg$ (69)

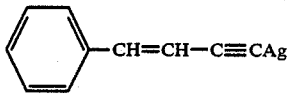

(70)

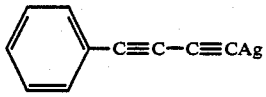

(71)

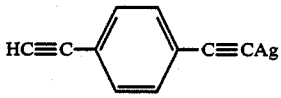

(72)

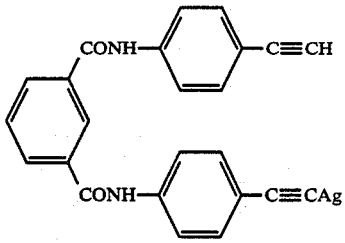

In the following, methods for synthesis of the acetylene silver compound according to the present invention are described. The acetylene silver compound according to the present invention can be obtained simply by mixing a source of silver ion such as silver nitrate and a corresponding acetylene compound in an appropriate solvent, for example, water and/or a hydrophilic solvent such as methanol. In such case, the mixing may be carried out in the presence of a hydrophilic binder such as gelatin. Purification of the resulting product or dispersion can be conducted in a manner well known in the art.

The most general synthesis method of the acetylene compound is a dehydrohalogenation of a dihalogenated compound in which two halogen atoms are positioned at vicinal carbon atoms or the same carbon atom or a halogenoolefin with a base. Further, a method using a reaction of a carbonyl compound with phosphorus pentachloride, followed by treatment with a base, a method using a dehalogenation reaction of a 1,2-dihalogenoalkene with zinc, a method using a phosphorus compound a method utilizing a fragmentation reaction, etc., are well know. Such methods are described in detail for example, in *Shin-Jikken Kagaku Koza,* Vol. 14 (I), pp. 253 to 306, Maruzen (1977).

The acetylene silver compound according to the present invention may be prepared in the same system, namely, together with other components for the heat-developable light-sensitive material in combination, or may be prepared out of the system, namely, separately from the other components for the heat-developable light-sensitive material. However, considering easy control in the case of preparation or ease of storage, it is preferable to prepare it separately from the other components for the heat-developable light-sensitive material.

Two or more kinds of the acetylene silver compounds according to the present invention can be used. Further, they can be used together with known organic silver salts. The acetylene silver compounds according to the present invention may be used in a layer containing light-sensitive silver halide or may be used in an adjacent layer thereof.

The organic silver compound of the present invention may be added in a form of precursor thereof which can be converted to the organic silver compound in a light-sensitive material.

The precursor of the organic silver compound preferably includes a silver salt of propiolic acids, a silver salt of cinnamic acids having a releasing group at $\alpha$- or $\beta$-position, a silver salt of benzilidenemalonic acids, and a silver salt of dihydrocinnamic acids.

The acetylene silver compounds according to the present invention can be used in over a wide range of concentrations. A typical amount to be coated is from 10 mg to 10 g/m$^2$ as silver. It is in the range of from 0.01 to 200 mols light-sensitive silver halide. The shape and particle size of the acetylene silver compounds according to the present invention are selected appropriately, but it is preferred that the average particle size is 10 $\mu$m or less.

The acetylene silver compounds according to the present invention can be used together with known organic compounds which are utilized for forming organic silver salts. The organic compounds include an aliphatic or aromatic carboxylic acid, a compound containing a mercapto group or a thiocarbonyl group having an $\alpha$-hydrogen atom, and a compound containing an imino group, etc.

Typical examples of the silver salts of aliphatic carboxylic acids include a silver salt derived from behenic acid, stearic acid, oleic acid, lauric acid, capric acid, myristic acid, palmitic acid, maleic acid, fumaric acid, tartaric acid, Freund's acid, linolic acid, linoleic acid, adipic acid, sebacic acid, succinic acid, acetic acid, butyric acid, and camphoric acid. Also, a silver salt derived from such an aliphatic carboxylic acid substituted with a halogen atom or a hydroxy group, or an aliphatic carboxylic acid having a thioether group, etc., can be used.

Typical examples of the silver salts of aromatic carboxylic acids and other carboxy group-containing compounds include a silver salt derived from benzoic acid, 3,5-dihydroxybenzoic acid, o-methylbenzoic acid, m-methylbenzoic acid, p-methylbenzoic acid, 2,4-dichlorobenzoic acid, acetamidobenzoic acid, p-phenylbenzoic acid, gallic acid, tannic acid, phthalic acid, terephthalic acid, salicylic acid, phenylacetic acid, pyromellitic acid, and 3-carboxymethyl-4-methyl-4-thiazoline 2-thione, etc.

Examples of the silver salts of compounds containing a mercapto group or a thiocarbonyl group include a silver salt derived from 3-mercapto-4-phenyl-1,2,4-triazole, 2-mercaptobenzimidazole, 2-mercapto-5-aminothiadiazole, 2-mercaptobenzothiazole, an S-alkyl thioglycolic acid (wherein the alkyl group has from 12 to 22 carbon atoms), a dithiocarboxylic acid such s dithioacetic acid, etc., a thioamide such as thiostearoylamide, etc., 5-carboxyl-1-methyl-2-phenyl-4-thiopyridine, and a mercapto compound such as mercaptotriazine, 2-mercaptobenzoxazole, mercaptooxadiazole, or 3-amino-5-benzylthio-1,2,4-triazole, etc., as described in U.S. Pat. No. 4,123,274, etc.

Typical examples of the silver salts of compounds containing an imino group include a silver salt derived from a benzotriazole or a derivative thereof as described in Japanese Patent Publication Nos. 30270/69 and 18416/70, for example, benzotriazole, an alkyl substituted benzotriazole such as methylbenzotriazole, etc., a halogen substituted benzotriazole such as 5-chlorobenzotriazole, etc., a carboimidobenzotriazole such as butylcarboimidobenzotriazole, etc., a nitrobenzotriazole as described in Japanese Patent Application (OPI) No. 118639/83, a sulfobenzotriazole, a carboxybenzotriazole or a salt thereof, a hydroxybenzotriazole, etc., as described in Japanese Patent Application (OPI) No. 118638/83, 1,2,4-triazole or 1-H-tetrazole as described in U.S. Pat. No. 4,220,709, a carbazole, a saccharin, an imidazole and a derivative thereof, etc. (The term "OPI" as used herein refers to a "published unexamined Japanese patent application")

Moreover, a silver salt as described in *Research Disclosure,* VOl. 170, No. 17029 (June, 1978), and a thermally decomposable silver salt of carboxylic acid as described in Japanese Patent Application No. 221535/83 are also used in the present invention.

In the present invention, silver halide is employed as a light-sensitive substance.

The silver halide used in the present invention includes silver chloride, silver chlorobromide, silver chloroiodide, silver bromide, silver iodobromide, silver chloroiodobromide, silver iodide, etc.

The process for preparing those silver halides is explained by taking the case of silver iodobromide. That is, the silver iodobromide is prepared by first adding a silver nitrate solution to a potassium bromide solution to form silver bromide particles, and then adding potassium iodide to the mixture.

Two or more kinds of silver halides in which the particle size and/or the silver halide composition are different from each other may be used in mixture.

The average particle size of the silver halide used in the present invention is preferably from 0.001 $\mu$m to 10 $\mu$m, and more preferably from 0.001 $\mu$m to 5 $\mu$m.

The silver halide used in the present invention may be used as formed. However, it may be chemically sensitized with a chemical sensitizing agent such as compounds of sulfur, selenium, or tellurium, etc., or compounds of gold, platinum, palladium, rhodium, or iridium, etc., a reducing agent such as tin halide, etc., or a combination thereof. Details thereof are described for example, in T. H. James, *The Theory of the Photographic*

*Process*, Fourth Edition, Chapter 5, pp. 149 to 169, Macmillan Publishing Co., 1977.

A suitable coating amount of the light-sensitive silver halide employed in the present invention is generally from 1 mg/m$^2$ to 10 g/m$^2$, calculated as silver.

Furthermore, the silver halide used in the present invention may be spectrally sensitized with methine dyes or other dyes. Details thereof are described for example, in Japanese Patent Application No. 199891/84, pp. 19 to 22. In accordance with the present invention, silver can be employed as an image forming substance. Moreover, various other image forming substances can be utilized in various image forming processes.

An example of the dye providing substance which can be used in the present invention is a coupler capable of reacting with a developing agent. A method utilizing such a coupler can form a dye upon a reaction of the coupler with an oxidation product of a deevloping agent which is formed by an oxidation reduction reaction between the silver salt and the developing agent and is described in many literatures. Specific examples of the developing agents and the couplers are described in greater detail, for example, in T. H. James, *The Theory of the Photographic Process*, Fourth Edition, pp. 291 to 334, and pp. 354 to 361 Macmillan Publishing Co.; Shinichi Kikuchi, *Shashin Kagaku* (Photographic Chemistry), Fourth Edition, pp. 284 to 295, Kyoritsu Shuppan Co.; etc.

Another example of the dye providing substance is a dye-silver compound in which an organic silver slt is connected to a dye. Specific examples of the dye-silver compounds are described in *Research Disclosure*, RD No. 16966, pp. 54 to 58 (May 1978), etc.

Still another example of the dye providing substance is an azo dye used in a heat-developable silver dye bleaching process. Specific examples of the azo dyes and the method for bleaching are described in U.S. Pat. No. 4,235,957, *Research Disclosure*, No. 14433, pp. 30 to 32 (April 1976), etc.

A further example of the dye providing substance is a leuco dye as described in U.S. Pat. Nos. 3,985,565, 4,022,617, etc.

A still further example of the dye providing substance is a compound having a function of releasing or diffusing imagewise a diffusible dye as utilized in a process as described in, for example, European Patent Nos. 76,492 and 79,056.

This type of compound can be represented by formula (LI)

$$(\text{Dye—X})_n\ Y \qquad \text{(LI)}$$

wherein Dye represents a dye moiety or a dye precursor moiety; X represents a chemical bond or a connecting group; Y represents a group having such a property that diffusibility of the compound represented by (Dye—X)n Y can be differentiated in correspondence or countercorrespondence to light-sensitive silver salts having a latent image distributed imagewise or a group having a property of releasing Dye in correspondence or countercorrespondence to light-sensitive silver salts having a latent image distributed imagewise, diffusibility of Dye released being different from that of the compound represented by (Dye—X)n Y; and n represents 1 or 2 and when n is 2, two Dye—X groups can be the same or different.

Specific examples of the dye providing substance represented by formula (LI) are known, and, for example, dye developers in which a hydroquinone type developing agent is connected to a dye component are described in U.S. Pat. Nos. 3,134,764, 3,362,819, 3,597,200, 3,544,545, 3,482,972, etc. Further, substances capable of releasing diffusible dyes upon an intramolecular nucleophilic displacement reaction are described in Japanese Patent Application (OPI) No. 63618/76, etc., and substances capable of releasing diffusible dyes pon an intramolecular rearrangement reaction of an isooxazolone ring are described in Japanese Patent Application (OPI) No. 111628/74, etc.

In any of these processes, diffusible dyes are released or diffused in portions where development does not occur. In contrast, in portions where development occurs, neither release nor diffusion of dyes.

It is very difficult to obtain images of a high S/N ratio according to these processes, because development and release or diffusion of dyes occur in parallel.

In order to eliminate this drawback, therefore, there has been provided a process in which a dye releasing compound is previously converted to an oxidized form thereof which does not have a dye releasing ability, the oxidized form of the compound is coexistent with a reducing agent or a precursor thereof and after development the oxidized form is reduced with the remaining reducing agent which is not oxidized to release a diffusible dye. Specific examples of dye providing substances which can be used in such a process are described in Japanese Patent Application (OPI) Nos. 110827/78, 130927/79, 164342/81 and 35533/78, etc.

On the other hand, substances capable of releasing diffusible dyes in portions where development occurred are also known. For example, substances capable of releasing diffusible dyes upon a reaction of couplers having diffusible dyes upon a reaction of couplers having diffusible dyes in the releasing groups thereof with oxidation products of developing agents are described in British Pat. No. 1,330,524, Japanese Patent Publication No. 39165/73, U.S. Pat. No. 3,443,940, etc., and substances capable of forming diffusible dyes upon a reaction of couplers having diffusion resistant groups in the releasing groups thereof with oxidation products of developing agents are described in U.S. Pat. No. 3,227,550, etc.

In these processes using color developing agents, there is a severe problem in that images are contaminated with oxidation decomposition products of the developing agents. Therefore, in order to eliminate such a problem, dye releasing compounds which have reducing property themselves and thus do not need the use of developing agents have been proposed. Typical examples of these dye releasing compounds are illustrated together with the relevant literatures in the following. The definitions for the substituents of the formulae set forth below are the same as those described in the cited literatures, respectively, and are incorporated by reference herein.

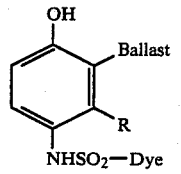

U.S. Pat. No. 3,928,312, etc.

-continued

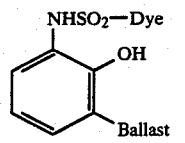

U.S. Pat. No. 4,053,312, etc.

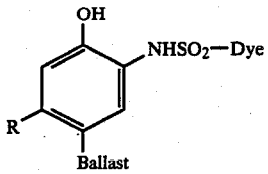

U.S. Pat. No. 4,055,428, etc.

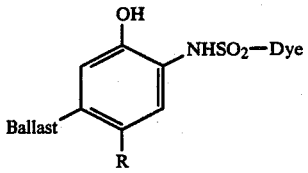

U.S. Pat. No. 4,336,322

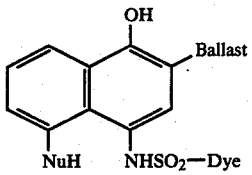

Japanese Patent Application (OPI) No. 65839/84

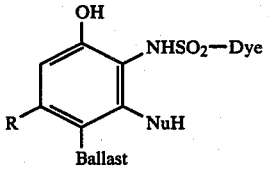

Japanese Patent Application (OPI) No. 69839/84

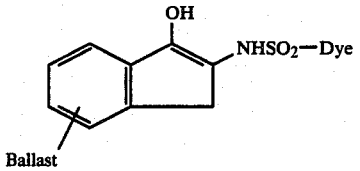

Japanese Patent Application (OPI) No. 3819/78

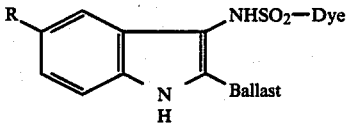

Japanese Patent Application (OPI) No. 104343/76

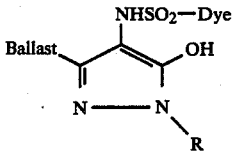

Japanese Patent Application (OPI) No. 104343/76

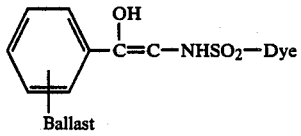

-continued

Japanese Patent Application (OPI) No. 104343/76

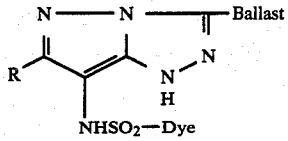

Research Disclosure RD. No. 17465, Oct. 1978

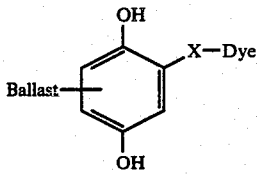

U.S. Pat. No. 3,725,062

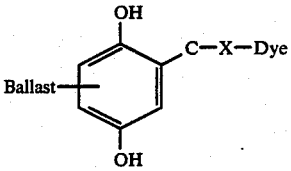

U.S. Pat. No. 3,728,113

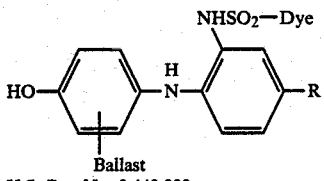

U.S. Pat. No. 3,443,939

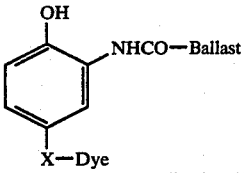

Japanese Patent Application (OPI) No. 116537/83

Any of various dye providing substances described above can be employed in the present invention.

In the present invention, it is preferred to use, as an image forming substance, a dye providing substance which reduces exposed light-sensitive silver halide and releases a mobile dye upon reaction with the exposed light-sensitive silver halide by heating. Among them, those represented by formula (I) described below are particularly preferred.

$$IR—SO_2—D \qquad (CI)$$

wherein IR represents a reducing group having a property of releasing a dye by cleavage in correspondence or countercorrespondence to light-sensitive silver salts having a latent image distributed imagewise, diffusibility of the dye thus released being different from that of the dye providing substance represented by the general formula (CI); and D represents a mobile image forming dye (including a precursor thereof) moiety which may include a connecting group to $SO_2$.

Preferably the reducing group (IR) in the due providing substance $IR—SO_2—D$ has an oxidation reduction potential with respect to a saturated calomel electrode of 1.2 V or less when measuring the polarographic half wave potential using acetonitrile as a solvent and sodium perchlorate as a base electrolyte.

Specific examples of the reducing group represented by IR include various groups as described in European Patent 76,492, pp. 19 to 24. Among them, preferred groups are represented by formula (CII)

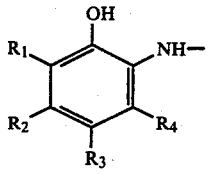

(CII)

wherein $R^1$, $R^2$, $R^3$, and $R^4$ each represents a hydrogen atom or a substituent selected from an alkyl group, a cycloalkyl group, an aryl group, an alkoxy group, an aryloxy group, an aralkyl group, an acyl group, an acylamino group, an alkylsulfonylamino group, an arylsulfonylamino group, an aryloxyalkyl group, an alkoxyalkyl group, an N-substituted carbamoyl group, an N-substituted sulfamoyl group, a halogen atom, an alkylthio group, or an arylthio group.

The alkyl moiety and the aryl moiety in the above described substituents may be further substituted with an alkoxy group, a halogen atom, a hydroxy group, a cyano group, an acyl group, an acylamino group, a substituted carbamoyl group, a substituted sulfamoyl group, an alkylsulfonylamino group, an arylsulfonylamino group, a substituted ureido group or a carboalkoxy group.

Furthermore, the hydroxy group and the amino group included in the reducing group represented by IR may be protected by a protective group represented by IR may be protected by a protective group which is reproducible by the action of a nucleophilic reagent.

In more preferred embodiments of the present invention, the reducing group IR is represented by formula (CIII)

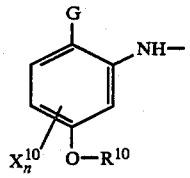

(CIII)

wherein G represents a hydroxy group or a group giving a hydroxy group upon hydrolysis; $R^{10}$ represents an alkyl group or an aromatic group; n represents an integer of 1 to 3; $X^{10}$ represents an electron donating substituent when n is 1, or substituents which may be the same or different, one of the substituents being an electron donating group and the second or second and third substituents being selected from an electron donating group or a halogen atom when n is 2 or 3, respectively; or one or more of the $X^{10}$ groups form a condensed ring with each other or with $—OR^{10}$; and the total number of the carbon atoms included in $R^{10}$ and $X^{10}$ is not less than 8.

Of the reducing groups represented by the general formula (CIII), other more preferred reducing groups IR are represented by formulae (CIIIa) and (CIIIb)

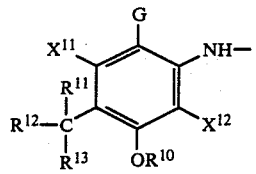

(CIIIa)

wherein G represents a hydroxy group or a group providing a hydroxy group upon hydrolysis; $R^{11}$ and $R^{12}$ (which may be the same or different) each represents an alkyl group or $R^{11}$ and $R^{12}$ together form a ring; $R^{13}$ represents a hydrogen atom or an alkyl group; $R^{10}$ represents an alkyl group or an aromatic group; $X^{11}$ and $X^{12}$ (which may be the same or different) each represents a hydrogen atom, an alkyl group, an alkoxy group, a halogen atom, an acylamino group or an alkylthio group; or $R^{10}$ and $X^{12}$, or $R^{10}$ and $R^{13}$ together form a ring,

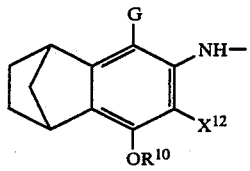

(CIIIb)

wherein G represents a hydroxy group or a group providing a hydroxy group upon hydrolysis; $R^{10}$ represents an alkyl group or an aromatic group; $X^{12}$ represents a hydrogen atom, an alkyl group, an alkoxy group, a halogen atom, an acylamino group or an alkylthio group; or $R^{10}$ and $X^{12}$ together form a ring.

Specific examples of the reducing groups represented by the above described general formulae (CIII), (CIIIa) and (CIIIb) are described in U.S. Pat. No. 4,055,428, Japanese Patent Application (OPI) Nos. 12642/81 and 16130/81, respectively.

Specific examples of the reducing groups represented by the above described in U.S. Pat. No. 4,055,428, Japanese Patent Application (OPI) Nos. 12642/81 and 16130/81, respectively.

In still additional more preferred embodiments of the present invention, the reducing group IR is represented by formula (CIV)

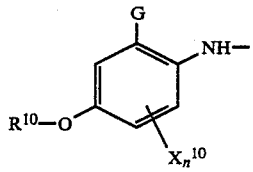

(CIV)

wherein G, $R^{10}$, $X^{10}$ and n each has the same meaning as defined in formula (CIII).

Of the reducing groups represented by the general formula (CIV), more preferred reducing groups IR are represented by the following general formulae (CIVa), (CIVb), and (CIVc).

(CIVa)

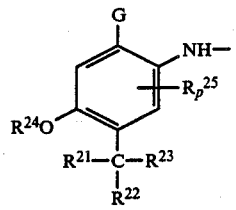

wherein G represents a hydroxy group or a group providing a hydroxy group upon hydrolysis; $R^{21}$ and $R^{22}$, which may be the same or different, each represents an alkyl group or an aromatic group, and $R^{21}$ and $R^{22}$ may be bonded to each other to form a ring; $R^{23}$ represents a hydrogen atom, an alkyl group or an aromatic group; $R^{24}$ represents an alkyl group or an aromatic group; $R^{25}$ represents an alkyl group, an alkoxy group, an alkylthio group, an arylthio group, a halogen atom or an acylamino group; p is 0, 1, or 2; $R^{24}$ and $R^{25}$ may be bonded to each other to form a condensed ring; $R^{21}$ and $R^{24}$ may be bonded to each other to form a condensed ring; $R^{21}$ and $R^{25}$ may be bonded to each other to form a condensed ring; and the total number of the carbon atoms included in $R^{21}$, $R^{22}$, $R^{23}$, $R^{24}$ and $R_p^{25}$ is more than 7;

(CIVb)

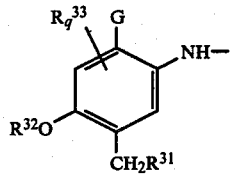

wherein G represents a hydroxy group or a group giving a hydroxy group upon hydrolysis; $R^{31}$ represents an alkyl group or an aromatic group; $R^{32}$ represents an alkyl group or an aromatic group; $R^{33}$ represents an alkyl group, an alkoxy group, an alkylthio group, an arylthio group, a halogen atom, or an acylamino group, q is 0, 1 or 2; or $R^{32}$ and $R^{33}$ together form a condensed ring; or $R^{31}$ and $R^{32}$ together form a condensed ring; or $R^{31}$ and $R^{33}$ together form a condensed ring; and the total number of the carbon atoms included in $R^{31}$, $R^{32}$, and $R_q^{33}$ is more than 7;

(CIVc)

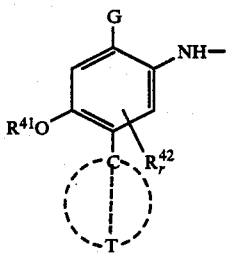

wherein G represents a hydroxy group or a group giving a hydroxy group upon hydrolysis; $R^{41}$ represents an alkyl group or an aromatic group; $R^{42}$ represents an alkyl group, an alkoxy group, an alkylthio group, an arylthio group, a halogen atom or an acylamino group; r is 0, 1 or 2; the the group of

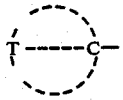

represents a group in which 2 to 4 saturated hydrocarbon rings are condensed, the carbon atom

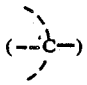

in the condensed ring which is connected to the phenyl nucleus (or a precursor thereof), is a tertiary carbon atom which composes one of the pivot of the condensed ring, one or more of the carbon atoms, excluding the tertiary carbon atom in the hydrocarbon ring may be substituted for oxygen atoms, or the hydrocarbon ring may have a substituent or may be further condensed with the aromatic ring; $R^{41}$ or $R^{42}$ and the group of

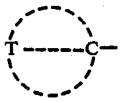

may be bonded to each other to form a condensed ring; and the total number of the carbon atoms included in $R^{41}$, $R_r^{42}$, and the group

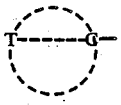

is not less than 7.

The dye moiety represented by D is preferably derived from azo dyes, azomethine dyes, anthraquinone dyes, naphthoquinone dyes, styryl dyes, nitro dyes, quinoline dyes, carbonyl dyes, and phthalocyanine dyes. Further, the dye moiety may be used in a form temporarily shifted to shorter wave length region. Specific examples of the dye moieties released from the dye providing compounds are described in the above-mentioned European Pat. No. 76,492, pp. 24 to 42.

Two or more kinds of dye providing substances can be employed together. In such cases, two or more kinds of dye providing substances may be used together in order to represent the same hue, or in order to represent black color.

Specific examples of the dye providing substances are described in Japanese Patent Application No. 199891/84, pp. 39 to 53.

The dye providing substance is generally employed in a range from 0.01 mol to 4 mols per mol of total silver salt of acetylene silver compound and silver halide.

The above described materials can form imagewise distribution of mobile dyes corresponding to exposure in the light-sensitive material by heat development, and processes of obtaining visible images by transferring the image dyes to a dye fixing material (the so-called diffusion transfer) are described in the above described cited patents and Japanese Patent Application (OPI) Nos. 168439/84 and 182448/84, etc.

The dye providing substance used in the present invention can be introduced into a layer of the light-sensitive material by known methods such as the method as described in U.S. Pat. No. 2,322,027. In this case, an organic solvent having a high boiling point or an organic solvent having a low boiling point as described below can be used. For example, the dye providing substance can be dispersed in a hydrophilic colloid after it is dissolved in an organic solvent having a high boiling point, for example, a phthalic acid alkyl ester (for example, dibutyl phthalate, dioctyl phthalate, etc.), a phosphoric acid ester (for example, diphenyl phosphate, triphenyl phosphate, tricresyl phosphate, dioctylbutyl phosphate, etc.), a citric acid ester (for example, tributyl acetylcitrate, etc.), a benzoic acid ester (for example, octyl benzoate, etc.), an alkylamide (for example, diethyl laurylamide, etc.), a fatty acid ester (for example, dibutoxyethyl succinate, dioctyl azelate, etc.), a trimesic acid ester (for example, tributyl trimesate, etc.), etc., or an organic solvent having a boiling point of about 30° C. to 160° C., for example, a lower alkyl acetate such as ethyl acetate, butyl acetate, etc., ethyl propionate, secondary butyl alcohol, methyl isobutyl ketone, -ethoxyethyl acetate, methyl cellosolve acetate, cyclohexanone, etc. The above described organic solvents having a high boiling point and organic solvents having a low boiling point may be used as a mixture thereof.

Further, it is possible to use a dispersion method using a polymer as described in Japanese Patent Publication No. 39853/76 and Japanese Patent Application (OPI) No. 59943/76. Moreover, various surface active agents can be used when the dye providing substance is dispersed in a hydrophilic colloid. For this purpose, the surface active agents as described herein can be used.

An amount of the organic solvent having a high boiling point used in the present invention is 10 g or less, and preferably 5 g or less, per g of the dye providing substance used.

In the present invention, it is desirable to incorporate a reducing agent into the light-sensitive material. Examples of the reducing agents including the above described dye providing substances having a reducing property in addition to substances which are generally known in the art as reducing agents.

The reducing agents used in the present invention include the following compounds.

Hydroquinone compounds (for example, hydroquinone, 2,5-dichlorohydroquinone, 2-chlorohydroquinone, etc.), aminophenol compounds (for example, 4-aminophenol, N-methylaminophenol, 3-methyl-4-aminophenol, 3,5-dibromoaminophenol, etc.), catechol compounds (for example, catechol, 4-cyclohexilcatechol, 3-methoxycatecol, 4-(N-octadecylamino)-catechol, etc.), phenylenediamine compound (for example, N,N-diethyl-p-phenylenediamine, 3-methyl-N,N-diethyl-p-phenylenediamine, 3-methoxy-N-ethyl-N-ethoxy-p-phenylenediamine, N,N,N',N'-tetramethyl-p-phenylenediamine, etc.).

Examples of more preferred reducing agents include 3-pyrazolidone compounds (for example, 1-phenyl-3-pyrazolidone, 1-phenyl-4,4-dimethyl-3-pyrazolidone, 4-hydroxymethyl-4-methyl-1-phenyl-3-pyrazolidone, 1-m-tolyl-3-pyrazolidone, 1-p-tolyl-3-pyrazolidone, 1-phenyl-4-methyl-3-pyrazolidone, 1-phenyl-5-methyl-3-pyrazolidone, 1-phenyl-4,4-bis(hydroxymethyl)-3-pyrazolidone, 1,4-dimethyl-3-pyrazolidone, 4-methyl-3-pyrazolidone, 4,4-dimethyl-3-pyrazolidone, 1-(3-chlorophenyl)-4-methyl-3-pyrazolidone, 1-(4-chlorophenyl)-4-methyl-3-pyrazolidone, 1-(4-tolyl)-4-methyl-3-pyrazolidone, 1-(2-tolyl)-4-methyl-3-pyrazolidone, 1-(4-tolyl)-3-pyrazolidone, 1-(3-tolyl)-3-pyrazolidone, 1-(3-tolyl)-4,4-dimethyl-3-pyrazolidone, 1-(2-trifluoroethyl)-4,4-dimethyl-3-pyrazolidone, and 5-methyl-3-pyrazolidone).

Various combinations of developing agents as described in U.S. Pat. No. 3,039,869 can also be used.

In the present invention, the amount of reducing agent added is generally from 0.01 mol to 20 mols per mol of total silver of acetylene silver compound and silver halide, and more preferably from 0.1 mol to 10 mols per mol of total of acetylene silver compound and silver halide silver.

In the present invention, various dye releasing assistants can be used. As the dye releasing assistants, bases or base precursors which are compounds showing a basic property and capable of activating development or compounds having the so-called nucleophilic property.

These dye releasing assistants are described in detail below.

(a) Base

Examples of preferred bases include an inorganic base, for example, a hydroxide, a secondary or tertiary phosphate, a borate, a carbonate, a quinolinate or a metaborate of an alkali metal or an alkaline earth metal; ammonium hydroxide; a hydroxide of a quaternary alkyl ammonium; a hydroxide of other metals, etc., and an organic base, for example, an aliphatic amine (such as a trialkyl-amine, a hydroxylamine, an aliphatic polyamine, etc.); an aromatic amine (such as an N-alkyl substituted aromatic amine, an N-hydroxyalkyl substituted aromatic amine, a bis p-(dialkylamino)phenyl methane, etc.); a heterocyclic amine; an amidine; a cyclic amidine; a quanidine; a cyclic guanidine, etc. Among them, those having pKa of 8 or more are particularly preferred.

(b) Base precursor

As a base precursor, a substance which releases a base which causes a reaction by heating, for example, a salt of an organic acid and a base which decomposes by heating with decarboxylation, a compound which releases an amine upon decomposition with an intramolecular nucleophilic displacement reaction, a Lossen rearrangement reaction, or a Beckmann rearrangement reaction are preferably employed. Examples of preferred base precursors include a salt of trichloroacetic acid as described in British Pat. No. 998,949, etc., a salt of—sulfonylacetic acid as described in U.S. Pat. No. 4,060,420, a salt of a propiolic acid as described in Japanese Patent Application No. 55700/83, a 2-carboxycarboxamide derivative as described in U.S. Pat. No. 4,088,496, a salt of a thermally decomposable acid using in addition to an organic base, an alkali metal or an alkaline earth metal as a base component as described in Japanese Patent Application (OPI) No. 195237/84, a hydroxamecarbamate utilizing a Lossen rearrangement as described in Japanese Patent Application (OPI) No. 168440/84, an aldeoximecarbamate which forms a nitrile upon heating as described in Japanese Patent Application No. 31614/83, etc. Further, base precursors as described in British Pat. No. 998,945, U.S. Pat. No. 3,220,846, Japanese Patent Application (OPI) No. 22625/75, and British Pat. No. 2,079,480, etc. are useful.

Specific examples of base precursors particularly suitable for use in the present invention are set forth below.

Guanidine trichloroacetate, methylguanidine trichloroacetate, potassium trichloroacetate, guanidine phenylsulfonylacetate, guanidine p-chlorophenylsulfonylacetate, guanidine p-methanesulfonylphenylsulfonylacetate, potassium phenylpropiolate, cesium phenylpropiolate, guanidine phenylpropiolate, guanidine p-chlorophenylpropiolate guanidine 2,4-dichlorophenylpropiolate, diguanidine p-phenylene-bis-propiolate, tetramethylammonium phenylsulfonylacetate, tetramethylammonium phenylpropiolate.

In the present invention, various kinds of development stopping agents can be employed for the purpose of obtaining good quality images irrespective of variations in processing temperature and processing time in the heat development. The details thereof are described in Japanese Patent Application No. 199891/84, pp. 63 to 64.

The binder which can be used in the present invention can be employed individually or in a combination thereof. A hydrophilic binder can be used as the binder according to the present invention. The typical hydrophilic binder is a transparent or translucent hydrophilic colloid, examples of which include natural substances, for example, a protein such as gelatin, a gelatin derivative, a cellulose derivative, etc., a polysaccharide such as starch, gum arabic, etc., and synthetic polymeric substances, for example, a water-soluble polyvinyl compound such as polyvinyl pyrrolidone, acrylamide polymer, etc. Another example of the synthetic polymeric substance is a dispersed vinyl compound in a latex form which is used for the purpose of increasing dimensional stability of a photographic material.

The amount of binder used is generally in a range of from 5 to 90% by weight, and preferably in a range from 5 to 50% by weight, based on the total amount of the coating.

Further, in the present invention, it is possible to use a compound which activates development simultaneously while stabilizing the image. Specific examples of these compounds and their relevant literatures are described in Japanese Patent Application No. 199891/84, pp. 65 to 66.

In the present invention, an image toning agent may be employed, if desired. The details thereof are described in Japanese Patent Application No. 199891/84, pp. 66 to 67.

The heat-developable light-sensitive material according to the present invention is effective in forming both negative type and positive type images. The negative or positive type image can be formed depending mainly on selection of the type of the light-sensitive silver halide. For instance, in order to produce direct positive type images, internal latent image type silver halide emulsions as described in U.S. Pat. Nos. 2,592,250, 3,206,313, 3,367,778 and 3,447,927, or mixtures of surface latent image type silver halide emulsions with internal latent image type silver halide emulsions as described in U.S. Pat. No. 2,996,382 can be used.

Various means of exposure can be used in the present invention. Latent images are obtained by imagewise exposure by radiant rays including visible light. Generally, light sources conventionally used, for example, sun light, a strobo, a flash, a tungsten lamp, a mercury lamp, a halogen lamp such as an iodine lamp, etc., a xenon lamp, a laser light source, a CRT light source, a plasma light source, a fluorescent tube, a light emitting diode, etc., can be used as a light source.

In the present invention, development is carried out by applying heat to the light-sensitive material. The heating means may be not plate, iron, a heat roller, exothermic materials utilizing carbon or titanium white, etc., or analogues thereof.

A support used in the light-sensitive material according to the present invention and a dye fixing material which is used, if desired, in the present invention is one which resists processing temperature. Generally useful supports, include not only glass, paper, metal and analogues thereof but also acetyl cellulose films, cellulose ester films, polyvinyl acetal films, polystyrene films, polycarbonate films, polyethylene terephthalate films and films which are related to these films, and resin materials. Further, paper supports laminated with a polymer such as polyethylene, etc., can be used. Polyesters as described in U.S. Pat. Nos. 3,634,089 and 3,725,070 are preferably used.

In the photographic light-sensitive material and the dye fixing material according to the present invention, the photographic emulsion layer and other binder layers may contain inorganic or organic hardeners. Specific examples thereof are described in Japanese Patent Aplication No. 199891/84, pp. 69 to 70.

In the case of using a dye providing substance which imagewise releases a mobile dye according to the present invention, the transfer of dye from the light-sensitive layer to the dye fixing layer can be carried out using a dye transfer assistant. Details thereof are described, for example in Japanese Patent Application No. 199891/84, pp. 70 to 71.

With respect to other compounds capable of being used in the light-sensitive material according to the present invention, for example, sulfamide derivatives, cathionic compounds having a pyridinium group, etc., surface active agents having a polyethylene oxide chain, antihalation and antiirradiation dyes, hardeners and mordanting agents, etc., it is possible to use those as described in European Pat. Nos. 76,492 and 66,282, West German Patent 3,315,485, Japanese Patent Application (OPI) Nos. 154445/84 and 152440/84, etc.

Further, as methods of exposure, etc., those cited in any the above described patents can be used.

According to the present invention, then, a heat-developable light-sensitive material which forms an image having high density and low fog upon a short period of developing time even when a small amount of a base precursor is employed and which does not show any adverse side-effect during heat development.

The present invention will be explained in greater detail with reference to the following examples, but the present invention should not be construed as being limited thereto.

EXAMPLE 1

A method of preparing a dispersion of acetylene silver compound according to the present invention is described below.

20 g of gelatin and 4.6 g of 4-acetylaminophenylacetylene were dissolved in a mixture of 1,000 ml of water and 200 ml of ethanol and the solution was maintained at 40° C. with stirring. A solution of 4.5 g of silver nitrate dissolved in 200 ml of water was added to the above prepared solution over 5 minutes. The thus prepared dispersion was adjusted in pH, precipitated and freed of excess salts. It was then adjusted to pH 6.3, whereby 300 g of a dispersion of Acetylene Silver Compound (8) was obtained.

Further, dispersions of Acetylene Silver Compounds (6), (18) and (35) according to the present invention were prepared in the same manner as described above, respectively.

A method of preparing a silver benzotriazole emulsion is described below.

28 g of gelatin and 13.2 g of benzotriazole were dissolved in 3,000 ml of water and the solution was mainteained at 40° C. with stirring. A solution of 17 g of silver nitrate dissolved in 100 ml of water was added to the above prepared solution over 2 minutes. The thus prepared silver benzotriazole emulsion was adjusted in pH, precipitated and freed of excess salts. It was then adjusted to pH 6.30, whereby 400 g of a silver benzotriazole emulsion was obtained.

A method of preparing a silver halide emulsion is described below.

To an aqueous solution of gelatin (prepared by dissolving 20 g of gelatin and 3 g of sodium chloride in 1,000 ml of water and maintained at 75° C.) were added simultaneously 600 ml of an aqueous solution containing sodium chloride and potassium bromide and an aqueous solution of silver nitrate (prepared by dissolving 0.59 moles of silver nitrate in 600 ml of water) over 40 minutes at an equal addition amount rate while stirring thoroughly. Thus, a mono-dispersed silver chlorobromide emulsion (bromide content: 80 mol%, crystal form: cubic, average grain size: 0.35 μm) was prepared.

After washing with water and desalting, 5 mg of sodium thiosulfate and 20 mg of 4-hydroxy-6-methyl-1,3,3a,7-tetrazaindene were added and then it was subjected to chemical sensitization at 60° C. The yield of the emulsion was 600 g.

A method of preparing a gelatin dispersion of a dye providing substance is described below.

A mixture of 5 g of Magenta Dye Providing Substance (A) described below, 0.5 g of succinic acid 2-ethylhexyl ester sulfonic acid sodium salt as a surface active agent, 10 g of tri-iso-nonyl phosphate and 30 ml of ethyl acetate was dissolved by heating at about 60° C. to prepare an uniform solution. This solution was mixed with 100 g of a 10% aqueous solution of lime-processed gelatin with stirring and the mixture was dispersed by means of a homogenizer at 10,000 rpm for 10 minutes. The dispersion thus obtained was designated a dispersion of magenta dye providing substance.

Magenta Dye Providing Substance (A)

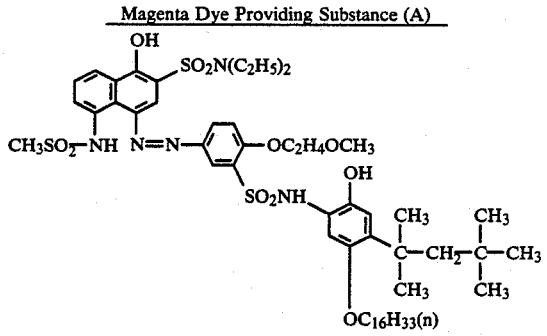

In the following, a method of preparing a light-sensitive coating composition is described.

| | | |
|---|---|---|
| (a) | Silver benzotriazole emulsion | 10 g |
| (b) | Light-sensitive silver chlorobromide emulsion | 15 g |
| (c) | Dispersion of dye providing substance | 25 g |
| (d) | 5% Aqueous solution of a compound having the following formula | 5 ml |

-continued

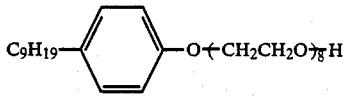

| | | |
|---|---|---|
| (e) | 10% Methanol solution of benzenesulfonamide | 5 ml |
| (f) | 7% Aqueous ethanol solution (water:ethanol = 1:1) of guanidine p-chlorophenylsulfonyl acetate | 15 ml |
| (g) | 0.04% Methanol solution of a dye having the following formula: | 4 ml |

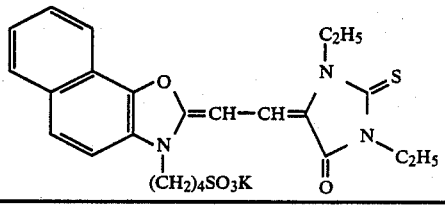

The above components (a) to (g) were mixed, and to the mixture were added a viscosity imparting agent and water to make the total volume to 100 ml. The resulting coating composition was coated on a polyethylene terephthalate film having a thickness of 180 μm at a wet layer thickness of 50 μm.

Then, the following coating composition for a protective layer was prepared.

| | | |
|---|---|---|
| (h) | 10% Aqueous solution of gelatin | 400 g |
| (i) | 7% Aqueous ethanol solution (water: ethanol = 1:1) of guanidine p-chlorophenylsulfonyl acetate | 240 ml |
| (j) | 4% Aqueous solution of a hardening agent having the following formula: $CH{=}CHSO_2CH_2CONH(CH_2)_2NHCOCH_2SO_2CH{=}CH_2$ | 50 ml |

The above components (h) to (j) were mixed and to the mixture were added a viscosity imparting agent and water to make the total volume to 1,000 ml. The resulting coating composition was coated on the above described light-sensitive layer at a wet layer thickness of 30 μm and dried. The light-sensitive material thus prepared was designated Light-Sensitive Material 101.

Light-Sensitive Material 102 was prepared in the same manner as described for Light-Sensitive Material 101 except using the dispersion of Acetylene Silver Compound (8) according to the present invention in place of the silver benzotriazole emulsion so as to make the same silver coating amount.

Further, Light-Sensitive Materials 103, 104 and 105 were prepared in the same manner as described for Light-Sensitive Material 102, except using the dispersions of acetylene Silver Compounds (6), (18) and (35) according to the present invention in place of Acetylene Silver Compound (8), respectively and dried.

There light-sensitive materials were imagewise exposed through a green filter for 1 second at 2,000 lux using a tungsten lamp and the uniformly heated for 10 seconds on a heat block heated at 150° C.

A method of preparing a dye fixing material in described below.

10 g of poly(methyl acrylate-co-N,N,N-trimethyl-N-vinylbenzylammonium chloride) (molar ratio of methyl acrylate to vinylbenzylammonium chloride was 1/1)

was dissolved in 200 ml of water and then uniformly mixed with 100 g of a 10% aqueous solution of lime-processed gelatin. The resulting mixture was uniformly coated at a wet layer thickness of 90 μm on a paper support laminated with polyethylene containing titanium dioxide dispersed therein and dried. The thus prepared material was used as a dye fixing material having a mordant layer.

The dye fixing material was supplied with 20 ml per $m^2$ of water on its coated layer and then each of the above described light-sensitive materials subjected to the heat treatment was superimposed on the dye fixing material in such a manner that their coated layers were in contact with each other. After heating for 6 seconds on a heat block at 80° C., the fixing material was separated from the light-sensitive material, whereupon a magenta color image was obtained in the dye fixing material.

The density of the resulting image was measured using a Macbeth reflection densitometer (RD-519). The results thus obtained are shown in Table 1.

TABLE 1

| Light-Sensitive Material | Organic Silver Compound | Maximum Density | Minimum Density |
|---|---|---|---|
| 101 (Comparison) | Silver Benzotriazole | 1.23 | 0.10 |
| 102 (Present Invention) | Compound (8) | 2.38 | 0.13 |
| 103 (Present Invention) | Compound (6) | 2.02 | 0.11 |
| 104 (Present Invention) | Compound (18) | 2.09 | 0.13 |
| 105 (Present Invention) | Compound (35) | 2.26 | 0.14 |

From the results shown in Table 1, it is clear that the light-sensitive materials containing the acetylene silver compounds according to the present invention provide images having high density and low fog.

EXAMPLE 2

On a polyethylene terephthalate film support were coated a first layer (undermost layer) to a sixth layer (uppermost layer) as shown below to prepare a color light-sensitive material having a multilayer structure which was designated Light-Sensitive Material 201. In the following table, the coating amount of each component is set forth in $mg/m^2$.

| | |
|---|---|
| Sixth Layer | Gelatin (1,000 $mg/m^2$), Base Precursor*3 (600 $mg/m^2$), Hardening Agent*6 (100 $mg/m^2$), Silica*5 (100 $mg/m^2$) |
| Fifth Layer (Green-sensitive emulsion layer) | Silver chlorobromide emulsion (bromide: 50 mol %, silver: 400 $mg/m^2$), benzenesulfonamide (180 $mg/m^2$), silver benzotriazole emulsion (silver: 100 $mg/m^2$), Sensitizing dye D-1 ($1 \times 10^{-6}$ $mol/m^2$) Base procursor*3 (500 $mg/m^2$), yellow dye providing substance (B) (400 $mg/m^2$), Gelatin (1,000 $mg/m^2$), Solvent having a high boiling point*4 (800 $mg/m^2$), surface active agent*2 (100 $mg/m^2$) |
| Fourth Layer (Intermediate Layer) | Gelatin (1,200 $mg/m^2$), Base Precursor*3 (600 $mg/m^2$) |
| Third Layer | Silver chlorobromide emulsion (bromide: 80 mol %, silver: 300 $mg/m^2$), Benzensulfonamide (180 $mg/m^2$), Silver benzotriazole emulsion (silver: 100 mg/,2) Sensitizing Dye D-2 ($8 \times 10^{-7}$ $mol/m^2$), base precursor*3 (450 $mg/m^2$), Magenta dye providing substance (A) (400 $mg/m^2$), Gelatin (1,000 $mg/m^2$), Solvent having a high boiling point*1 (600 $mg/m^2$), Surface active agent*2 (100 $mg/m^2$) |
| Second Layer (Intermediate Layer) | Gelatin (1,000 $mg/m^2$), Base precursor*3 (600 $mg/m^2$) |
| First Layer (Infrared-sensitive emulsion layer) | Silver chlorobromide emulsion (bromide: 50 ml %, silver: 300 $mg/m^2$), Benzenesulfonamide (180 $mg/m^2$), Silver benzotriazole emulsion (Silver: 100 $mg/m^2$), Sensitizing dye D-3 ($1 \times 10^{-6}$ $mol/m^2$), Base precursor*3 (500 $mg/m^2$), Cyan dye providing substance (C) (300 $mg/m^2$), Gelatin (1,000 $mg/m^2$), Solvent having a high boiling point*4 (600 $mg/m^2$), Surface active agent*2 (100 $mg/m^2$) Support |

*1 Tricresyl phosphate

*2 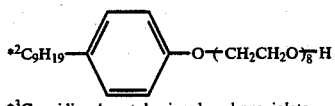

*3 Guanidine 4-acetylaminophenyl propiolate

*4 $(iso\text{-}C_9H_{19}O)_3P{=}O$

*5 Size: 4 μm

*6 1,2-Bis(vinylsulfonylacetamido)ethane

Sensitizing Dye D - 1

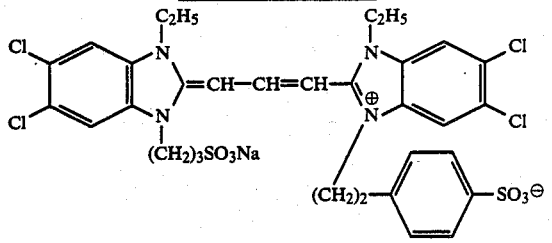

Sensitizing Dye D - 2

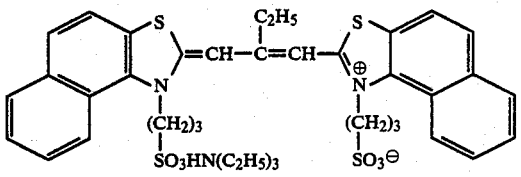

Sensitizing Dye D - 3

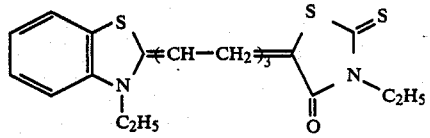

A method of preparing the silver halide emulsion for the fifth layer and the first layer is described in the following.

To an aqueous solution of gelatin (prepared by dissolving 20 g of gelatin and 3 g of sodium chloride in 1,000 ml of water and maintained at 75° C.) were added simultaneously 600 ml of an aqueous solution containing sodium chloride and potassium bromide and an aqueous solution of silver nitrate (prepared by dissolving 0.59 moles of silver nitrate in 600 ml of water) over 40 minutes at an equal addition amount rate while stirring thoroughly. Thus, a mono-dispersed silver chlorobromide emulsion (bromide content: 50 mol%, crystal form: cubic, average grain size: 0.40 μm) was prepared.

After washing with water and desalting, 5 mg of sodium thiosulfate and 20 mg of 4-hydroxy-6-methyl-1,3,3a,7-tetraazaindene were added and then it was subjected to chemical sensitization at 60° C. The yield of the emulsion was 600 g.

Methods of preparing the silver halide emulsion for the third layer and the silver benzotriazole emulsion were the same as those described in Example 1.

A method of preparing a gelatin dispersion of dye providing substance is described in the following.

A mixture of 5 g of Yellow Dye providing Substance (B) described below, 0.5 g of succinic acid 2-ethylhexyl ester sulfonic acid sodium salt, as a surface active agent, 10 g of tri-iso-nonyl phosphate and 30 ml of ethyl acetate was dissolved by heating at about 60° C. to prepare a uniform solution. This solution was mixed with 100 g of a 10% aqueous solution of lime-processed gelatin with stirring and the mixture was dispersed by means of a homogenizer at 10,000 rpm for 10 minutes. The dispersion thus obtained was designated as a dispersion of yellow dye providing substance.

A dispersion of magenta dye providing substance was prepared in the same manner as described above except using Magenta Dye Providing Substance (A) described in Example 1 and using 7.5 g of tricresyl phosphate as an organic solvent having a high boiling point. Further, a dispersion of cyan dye providing substance was prepared in the same manner for the dispersion of yellow dye providing substance as described above, except using Cyan Dye Providing Substance (C) described below.

Yellow Dye Providing Substance (B)

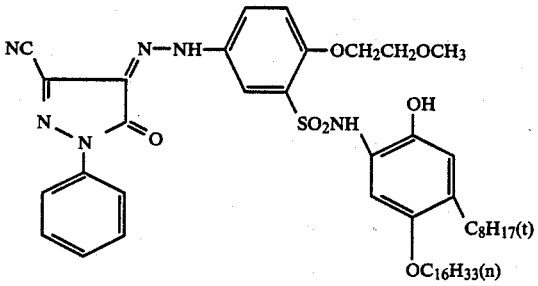

Cyan Dye Providing Substance (C)

-continued

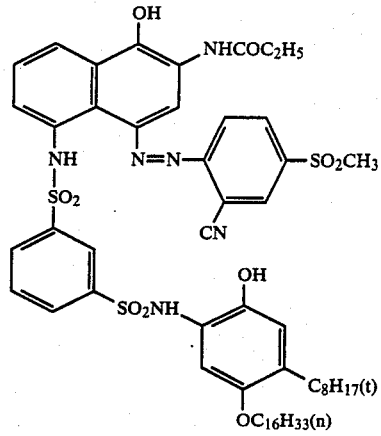

Light-Sensitive Materials 202, 203, 204, and 205 were prepared in the same manner as described for Light-Sensitive Material 201 except using the dispersions of Acetylene Silver Compounds (8), (6), (18), and (35) according to the present invention same as used in Example 1 in a silver coating amount of 100 mg/m$^2$ in place of the silver benzotriazole emulsions employed in the first layer, the third layer and the fifth layer, respectively.

Further, Light-Sensitive Material 206 was prepared in the same manner as described for Light-Sensitive Material 202, except that the amount of the base precursor in the first, third, and fifth layers was reduced to one half.

The above described multilayer color light-sensitive materials (Light-Sensitive Materials 201, to 206) were exposed through a three color separation filter of G, R and IR (G: filter transmitting a band of 500 nm to 600 nm, R: filter transmitting a band of 600 nm to 700 nm; IR: filter transmitting a band of 700 nm or more), the density of which continuously changes, for 1 second at 500 lux using a tungsten lamp and then heated for 5 seconds or 15 seconds on a heat block which had been heated at 150° C.

To the coated layer of the dye fixing material (same as described in Example 1) was applied 20 ml of m$^2$ of water, and the above heated light-sensitive material was then superimposed on the dye fixing material in such a manner that their coated layers were in contact with each other.

After heating for 6 seconds on a heat block maintained at 80° C. the dye fixing material was separated from the light-sensitive material, whereupon yellow, magenta and cyan color images were obtained in the dye fixing material corresponding to the three color separation filter of G (green), R (red), and IR (infrared) respectively.

The maximum density (D max) and the minimum density (D min) of each color were measured using a Macbeth reflection densitometer (RD-519).

The results thus obtained are shown in Table 2.

TABLE 2

| Light-Sensitive Material | Organic Silver Compound | Developing Time (sec) | D max | | | D min | | |
|---|---|---|---|---|---|---|---|---|
| | | | Yellow | Magenta | Cyan | Yellow | Magenta | Cyan |
| 201 (Comparison) | Silver Benzotriazole | 5 | 0.7 | 0.6 | 0.4 | 0.10 | 0.10 | 0.10 |
| 201 (Comparison) | Silver Benzotriazole | 15 | 1.8 | 1.7 | 1.7 | 0.11 | 0.11 | 0.12 |

TABLE 2-continued

| Light-Sensitive Material | Organic Silver Compound | Developing Time (sec) | D max | | | D min | | |
|---|---|---|---|---|---|---|---|---|
| | | | Yellow | Magenta | Cyan | Yellow | Magenta | Cyan |
| 202 (Present Invention) | Compound (8) | 5 | 1.8 | 2.3 | 2.4 | 0.10 | 0.12 | 0.12 |
| 202 (Present Invention) | Compound (8) | 15 | 2.0 | 2.3 | 2.4 | 0.14 | 0.13 | 0.13 |
| 203 (Present Invention) | Compound (6) | 5 | 1.7 | 2.2 | 2.2 | 0.10 | 0.11 | 0.11 |
| 203 (Present Invention) | Compound (6) | 15 | 2.0 | 2.3 | 2.4 | 0.14 | 0.13 | 0.14 |
| 204 (Present Invention) | Compound (18) | 5 | 1.8 | 2.3 | 2.2 | 0.11 | 0.12 | 0.12 |
| 204 (Present Invention) | Compound (18) | 15 | 2.0 | 2.3 | 2.4 | 0.14 | 0.13 | 0.14 |
| 205 (Present Invention) | Compound (35) | 5 | 1.8 | 2.1 | 2.2 | 0.11 | 0.12 | 0.13 |
| 205 (Present Invention) | Compound (35) | 15 | 2.0 | 2.3 | 2.4 | 0.14 | 0.14 | 0.14 |
| 206 (Present Invention) | Compound (8) | 5 | 0.8 | 1.5 | 1.8 | 0.10 | 0.11 | 0.10 |
| 206 (Present Invention) | Compound (8) | 15 | 1.9 | 2.3 | 2.4 | 0.11 | 0.12 | 0.12 |

From the results shown in Table 2, it is clear that the light-sensitive material can provide sufficiently high image densities even upon a short period of developing time. Further, images having sufficiently high density are obtained upon the developing time of 15 seconds even when the amount of the base precursor employed is reduced to one half. This fact means that the amount of the base precursor can be reduced in accordance with the present invention.

EXAMPLE 3

A method of preparing a silver halide emulsion is described in the following.

40 g of gelatin and 26 g of potassium bromide (KBr) were dissolved in 3,000 ml of water and the solution was maintained at 50° C. with stirring. A solution of 34 g of silver nitrate dissolved in 200 ml of water was added to the above-prepared solution over a 10 minute period. Then, a solution of 3.3 g of potassium iodide (KI) dissolved in 100 ml of water was added over a 2 minute period. The thus-prepared silver iodobromide emulsion was adjusted in pH, precipitated, and freed of excess salts. It was then adjusted to a pH of 6.0, thereby 400 g of a silver iodobromide emulsion was obtained.

A method of preparing a gelatin dispersion of a dye providing substance is described in the following.

A mixture of 10 g of Dye Providing Substance (D) described below, 0.5 g of succinic acid 2-ethylhexyl ester sulfonic acid sodium salt as a surface active agent, 20 g of tricresyl phosphate (TCP), and 30 ml of ethyl acetate was dissolved by heating at about 60° C. to prepare a solution. This solution was mixed with 100 g of a 10% aqueous solution of gelatin with stirring and the mixture was dispersed by means of a homogenizer at 10,000 rpm for 10 minutes. The dispersion thus obtained was designated a dispersion of dye providing substance.

Dye Providing Substance (D)

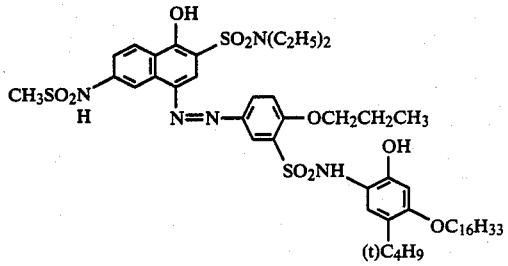

In the following, a method of preparing a light-sensitive coating composition is described.

| | | |
|---|---|---|
| (a) | Light-Sensitive silver iodobromide emulsion | 25 g |
| (b) | Dispersion of dye providing substance | 33 g |
| (c) | 5% Aqueous solution of a compound having the following formula: | 10 ml |

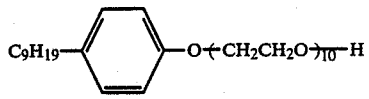

| | | |
|---|---|---|
| (d) | Solution of 1.5 g of guanidine 4-acetylaminophenyl propiolate dissolved in 10 ml of ethanol | |
| (e) | Solution of 0.4 g of $(CH_3)_2NSO_2NH_2$ dissolved in 4 ml of methanol | |

The above components (a) to (e) were mixed and dissolved by heating. The resulting solution was then coated on a polyethylene terephthalate film having a thickness of 180 μm, to have a wet layer thickness of 30 μm and then dried. On the thus formed layer was further coated the following coating composition in a wet layer thickness of 25 μm to thereby form a protective layer.

Composition of Protective Layer

| | | |
|---|---|---|
| (a) | 10% Aqueous solution of gelatin | 30 g |
| (b) | 4% Aqueous solution of a hardening agent having the following formula: | 8 ml |

-continued

| | |
|---|---|
| $CH_2{=}CHSO_2CH_2CONH(CH_2)_2NHCOCH_2SO_2CH{=}CH_2$ | |
| (c) Water | 70 ml |

The light-sensitive material thus prepared was designated Light-Sensitive Material 301.

Light-Sensitive Materials 302, 303, 304, and 305 were prepared in the same manner as described for Light-Sensitive Material 301 except that 10% of the silver coating amount of the silver iodobromide emulsion was replaced with the dispersions of Acetylene Silver Compounds (8), (6), (18), and (35) according to the present invention same as used in Example 1, respectively.

Further, Light-Sensitive Material 306 was prepared in the same manner as described for Light-Sensitive Material 301, except that the amount of guanidine 4-acetylaminophenyl propiolate in component (d) was increased to 2.1 g.

After drying these light-sensitive materials were exposed imagewise for 10 seconds using a tungsten lamp at 2,000 lux. These materials were then uniformly heated for 20 seconds on a heat block maintained at 140° C.

The dye fixing material (same as described in Example 1) was soaked in water and then the above heated light-sensitive material was superimposed on the dye fixing material in such a manner that their coated layers were in contact with each other.

After heating for 6 seconds on a heat block maintained at 80° C., the dye fixing material was separated from the light-sensitive material, whereupon a negative magenta color image was obtained in the dye fixing material.

The densities of the negative color image were measured using a Macbeth reflection densitometer (RD-519). The results thus obtained are shown in Table 3.

TABLE 3

| Light-Sensitive Material | Acetylene Silver Compound | Maximum Density | Minimum Density |
|---|---|---|---|
| 301 (Comparison) | none | 1.05 | 0.10 |
| 302 (Present Invention) | Compound (8) | 2.13 | 0.13 |
| 303 (Present Invention) | Compound (6) | 2.01 | 0.12 |
| 304 (Present Invention) | Compound (18) | 2.11 | 0.14 |
| 305 (Present Invention) | Compound (35) | 2.20 | 0.14 |
| 306 (Comparison) | none | 2.05 | 0.16 |

From the results shown in Table 3, it is clear that the images having high density and low fog are obtained using a small amount of the acetylene silver compounds according to the present invention. Further, it is understood that the amount of the base precursor can be remarkably reduced by means of using the acetylene silver compounds according to the present invention.

EXAMPLE 4

Method for Preparation of Silver Benzotriazole Emulsion Containing Light-Sensitive Silver Bromide 6.5 g of benzotriazole and 10 g of gelatin were dissolved in 1,000 ml of water and the solution was maintained at 50° C. with stirring. A solution of 8.5 g of silver nitrate dissolved in 100 ml of water was added to the above-prepared solution over a 2 minute period. Then, a solution of 1.2 g of potassium bromide dissolved in 50 ml of water was added over a 2 minute period. The thus-prepared emulsion was adjusted in pH, precipitated, and freed of excess salts. It was then adjusted to a pH of 6.0, whereby 200 g of a silver benzotriazole emulsion containing silver bromide was obtained.

Method for Preparation of a Gelatin Dispersion of a Dye Providing Substance

A mixture of 10 g of a dye providing substance having the structure shown below, 0.5 g of succinic acid 2-ethylhexyl ester sulfonic acid sodium salt, as a surface active agent, 4 g of tricresyl phosphate (TCP) and 20 ml of cyclohexanone was dissolved by heating at about 60° C. to prepare a uniform solution. This solution was mixed with 100 g of a 10% aqueous solution of lime-processed gelatin with stirring and the mixture was dispersed by means of a homogenizer at 10,000 rpm for 10 minutes.

Dye Providing Substance

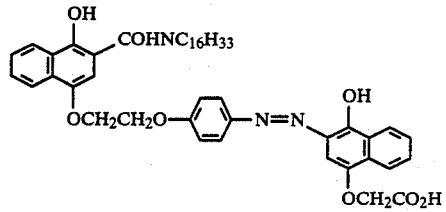

A method of preparing a light-sensitive coating composition is described below.

| | | |
|---|---|---|
| (a) | Silver benzotriazole emulsion containing light-sensitive silver bromide | 10 g |
| (b) | Dispersion of dye providing substance | 3.5 g |
| (c) | Base precursor: guanidine 3-acetylamino-4-methoxyphenyl propiolate | 0.20 g |
| (d) | Gelatin (10% aqueous solution) | 5 g |
| (e) | Solution of 0.2 g of 2,6-dichloro-4-aminophenol dissolved in 2 ml of methanol | |
| (f) | 10% Aqueous solution of a compound having the following formula: | 1 ml |

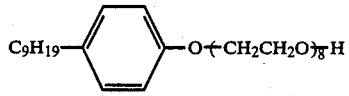

The above components (a) to (f) were mixed and dissolved by heating and the solution was coated on a polyethylene terephthalate film having a thickness of 180 μm to have a wet layer thickness of 30 μm.

On the thus formed layer was further coated the solution having the components (a) to (d) described below at a wet layer thickness of 30 μm as a protective layer and dried to prepare Light-Sensitive Material 401.

| | | |
|---|---|---|
| (a) | 10% Aqueous solution of gelatin | 30 ml |
| (b) | 4% Aqueous solution of a hardening agent having the following formula: $CH_2{=}CHSO_2CH_2CONH(CH_2)_2NHCOCH_2SO_2CH{=}CH_2$ | 8 ml |
| (c) | Water | 40 ml |
| (d) | Solution of 0.8 g of guanidine 3-acetylamino-4-methoxyphenyl propiolate dissolved in 20 ml of water | |

Further, Light-Sensitive Material 402 was prepared in the same manner as described for Light-Sensitive Material 401, except using an emulsion of Acetylene Silver Compound (8) containing light-sensitive silver bromide prepared in the manner as described below in place of the silver benzotriazole emulsion containing light-sensitive silver bromide.

Method for Preparation of an Emulsion of Acetylene Silver Compound (8) Containing Light-Sensitive Silver Bromide 8.7 g of 4-acetylaminophenylacetylene and 10 g of gelatin were dissolved in a mixture of 300 ml of ethanol and 1,000 ml of water and the solution was maintained at 50° C. with stirring. A solution of 8.5 g of silver nitrate dissolved in 100 ml of water was added to the above-described solution over a 2 minute period. Then, a solution of 1.2 g of potassium bromide dissolved in 50 ml of water was added over a 2 minute period. The thus-prepared emulsion was adjusted in pH, precipitated, and freed of excess salts. It was then adjusted to a pH of 6.0, whereby 200 g of an emulsion of Acetylene Silver Compound (8) containing light-sensitive silver bromide was obtained.

Light-Sensitive Materials 401 and 402 thus-prepared were exposed imagewise at 2,000 lux for 10 seconds using a tungsten lamp and then uniformly heated for 20 seconds on a heat block which had been heated at 150° C.

Each of the heated light-sensitive materials was superimposed on the dye fixing material (same as described in Example 1) soaked in water, in such a manner that their coated layers were in contact with each other. After heating for 6 seconds on a heat block maintained at 80° C., the dye fixing material was separated from the light-sensitive material, whereupon a negative magenta color image was obtained in the due fixing material.

The densities of the negative color image were measured using a Macbeth reflection densitometer (RD-519). The results thus obtained are shown in Table 4.

TABLE 4

| Light-Sensitive Material | Maximum Density | Minimum Density |
|---|---|---|
| 401 (Comparison) | 1.21 | 0.14 |
| 402 (Present Invention) | 2.18 | 0.18 |

From the results shown in Table 4, it is apparent that the acetylene silver compound according to the present invention provides images having high density and low fog.

EXAMPLE 5

Method for Preparation of a Gelatin Dispersion of a Dye Providing Substance

A mixture of 5 g of a dye providing substance which is capable of being reduced having the structure shown below, 4 g of an electron donative substance having the structure shown below, 0.5 g of succinic acid 2-ethylhexyl ester sulfonic acid sodium salt, 10 g of tricresyl phosphate (TCP) and 20 ml of cyclohexanone was dissolved by heating at about 60° C. to prepare a solution. This solution was mixed with 100 g of a 10% aqueous solution of gelatin with stirring and the mixture was dispersed by means of a homogenizer at 10,000 rpm for 10 minutes.

Dye Providing Substance

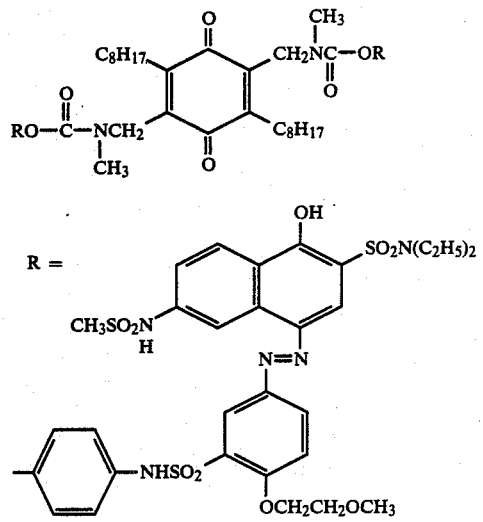

Electron Donative Substance:

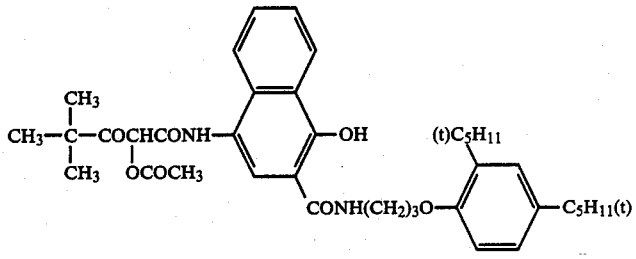

A method of preparing a light-sensitive coating composition is described in the following.

| | | |
|---|---|---|
| (a) | Silver benzotriazole emulsion containing light-sensitive silver bromide (same as described in Example 4) | 10 g |
| (b) | Dispersion of dye providing substance | 3.5 g |
| (c) | Base precursor: guanidine 4-methylsulfonyl phenylsulfonyl acetate | 0.20 g |
| (d) | 5% Aqueous solution of a compound having the following formula: 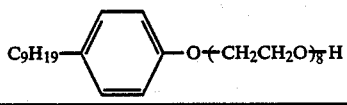 | 1.5 ml |

The above components (a) to (d) wre mixed and dissolved by heating and the mixture was coated on a polyethylene terephthalate film at a wet layer thickness of 30 μm and dried.

On the thus formed layer was further coated the solution containing components (a) to (d) as described below at a wet layer thickness of 30 μm as a protective layer and dried to prepare Light-Sensitive Material 501.

| | |
|---|---|
| (a) 10% Aqueous solution of gelatin | 30 g |
| (b) Base precursor: guanidine 4-methylsulfonyl-phenylsulfonyl acetate | 1.0 g |
| (c) 4% Aqueous solution of a hardening agent having the following formula: $CH_2{=}CHSO_2CH_2CONH(CH_2)_2NHCOCH_2SO_2CH{=}CH_2$ | 8 ml |
| (d) Water | 62 ml |

Further, Light-Sensitive Material 502 was prepared in the same manner as described for Light-Sensitive Material 501 except using the emulsion of acetylene Silver Compound (8) containing light-sensitive silver bromide same as described in Example 4 in place of the silver benzotriazole emulsion containing light-sensitive silver bromide.

Light-Sensitive Materials 501 and 502 thus-prepared were exposed imagewise at 2,000 lux for 10 seconds using a tungsten lamp and then uniformly heated for 30 seconds on a heat block which had been heated to 140° C.

The same procedure as described in Example 1 was conducted using the dye fixing material as described in Example 1, whereby a positive magenta color image was obtained in the dye fixing material.

The densities of the positive color image were measured using a Macbeth reflection densitometer (RD-519). The results thus obtained are shown in Table 5.

TABLE 5

| Light-Sensitive Material | Maximum Density | Minimum Density |
|---|---|---|
| 501 (Comparison) | 1.62 | 0.20 |
| 502 (Present Invention) | 2.01 | 0.21 |

From the results shown in Table 5, it is clear that the acetylene silver compound according to the present invention can provide images having high density and low fog in a system for forming positive images.

EXAMPLE 6

A silver benzotriazole emulsion same as described in Example 4 was prepared. A dispersion of a dye providing substance was prepared in the same manner as described in Example 1, except using 5 g of a dye providing substance having the structure shown below in place of Dye Providing Substance (A).

Dye Providing Substance:

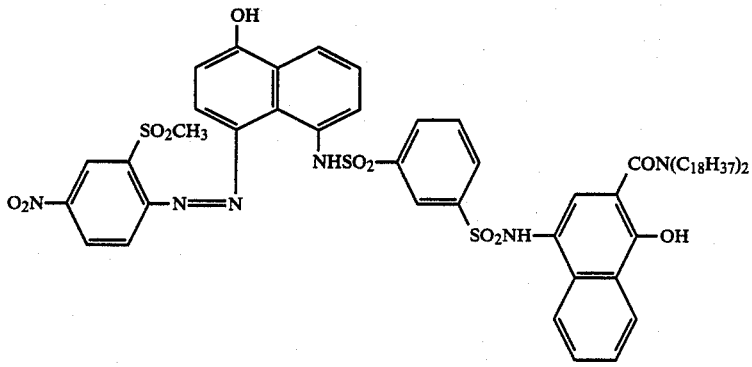

A light-sensitive coating composition was prepared in the following manner.

| | |
|---|---|
| (a) Silver benzotriazole emulsion containing light-sensitive silver bromide | 10 g |
| (b) Dispersion of dye providing substance | 3.5 g |
| (c) Solution of 0.28 g of $(CH_3)_2NSO_2NH_2$ dissolved in 4 ml of water | |
| (d) Solution of 0.2 g of 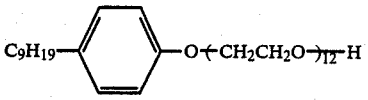 dissolved in 4 ml of water | |

The above components (a) to (d) were mixed and dissolved by heating and the mixture was coated on a polyethylene terephthalate film having a thickness of 180 μm to have a wet layer thickness of 30 μm. On the thus formed layer was further coated the solution having the components (a) to (c) described below at a wet layer thickness of 25 μm as a protective layer and dried to prepare Light-Sensitive Material 601.

| | |
|---|---|
| (a) 10% Aqueous solution of gelatin | 30 g |
| (b) 4% Aqueous solution of a hardening agent having the following formula: $CH_2{=}CHSO_2CH_2CONH(CH_2)_2NHCOCH_2SO_2CH{=}CH_2$ | 8 ml |
| (c) Water | 62 ml |

Further, Light-Sensitive Material 602 was prepared in the same manner as described for Light-Sensitive Material 601 except using the emulsion of Acetylene Silver Compound (8) containing light-sensitive silver bromide same as described in Example 4 in place of the silver benzotriazole emulsion containing light-sensitive silver bromide.

Light-Sensitive Materials 601 and 602 thus-prepared were exposed imagewise at 2,000 lux for 10 seconds using a tungsten lamp, and then uniformly heated for 30 seconds on a heat block which had been heated at 160° C.

The same procedure as described in Example 1 was conducted using the dye fixing material as described in Example 1, whereupon a color image was obtained, the densities of which were measured in the same manner as described in Example 1. The results thus obtained are shown in Table 6.

TABLE 6

| Light-Sensitive Material | Maximum Density | Minimum Density |
|---|---|---|
| 601 (Comparison) | 1.32 | 0.24 |

TABLE 6-continued

| Light-Sensitive Material | Maximum Density | Minimum Density |
|---|---|---|
| 602 (Present Invention) | 1.88 | 0.25 |

From the results shown in Table 6, it is apparent that the acetylene silver compound according to the present invention can provide images having high density and low fog in an image forming method in which a base precursor is not employed.

These results set forth in the above exampes clearly demonstrate the effects according to the present invention.

While the invention has been described in detail and with reference to specific embodiments thereof, it will be apparent to one skilled in the art that various changes and modifications can be made therein without departing from the spirit and scope thereof.

What is claimed is:

1. A heat-developable light-sensitive material comprising a support having thereon at least a light-sensitive silver halide, a reducing agent, a binder, and an acetylene silver compound represented by formula (I):

$$R—C{\equiv}CAg \quad (I)$$

wherein R represents a substituted or unsubstituted alkyl group, a substituted or unsubstituted cycloalkyl group, a substituted or unsubstituted alkenyl group, a substituted or unsubstituted alkynyl group, a substituted or unsubstituted aralkyl group, a substituted or unsubstituted aryl group, a substituted or unsubstituted heterocyclic group.

2. A heat-developable light-sensitive material as in claim 1, wherein a substituent for the substituted alkyl group represented by R is an alkoxy group, a hydroxy group, a cyano group, a halogen atom, a sulfonamido group, or a substituted or unsubstituted alkynyl group.

3. A heat-developable light-sensitive material as in claim 1, wherein a substituent for the substituted aryl group represented by R is an alkyl group, a cyano group, a nitro group, an amino group, an acylamino group, a sulfonamido group, an alkoxy group, an aryloxy group, an alkoxycarbonyl group, a ureido group, a carbamoyl group, an acyloxy group, a heterocyclic group, an alkylsulfonyl group, a carboxylic acid group, a sulfonic acid group, a sulfamoyl group, a halogen atom, or a substituted or unsubstituted alkynyl group.

4. A heat-developable light-sensitive material as in claim 1, wherein the heterocyclic group represented by R is a 5-membered or 6-membered heterocyclic group including as a hetero atom, at least one of a nitrogen atom, an oxygen atom, and a sulfur atom.

5. A heat-developable light-sensitive material as in claim 1, wherein a substituent for the substituted heterocyclic group represented by R is an alkoxy group, a cyano group, a halogen atom, a carbamoyl group, a sulfamoyl group, or a substituted or unsubstituted alkynyl group.

6. A heat-developable light-sensitive material as in claim 1, wherein R represents a phenyl group or a substituted phenyl group.

7. A heat-developable light-sensitive material as in claim 1, wherein the amount of the acetylene silver compound is in a range of from 0.01 mol to 200 mols per mol of the light-sensitive silver halide.

8. A heat-developable light-sensitive material as in claim 1, wherein the material further contains an image-forming substance.

9. A heat-developable light-sensitive material as in claim 8, wherein the image-forming substance is a coupler capable of forming a color image upon reaction with an oxidation product of a developing agent.

10. A heat-developable light-sensitive material as in claim 8, wherein the image forming substance is a dye-providing substance which releases a mobile dye.

11. A heat-developable light-sensitive material as in claim 10, wherein the dye providing substance is a compound represented by formula (LI)

$$(Dye—X)_nY \quad (LI)$$

wherein Dye represents a dye moiety or a dye precursor moiety; X represents a chemical bond or a connecting group; Y represents a group having a property such that diffusibility of the compound represented by $(Dye—X)_nY$ can be differentiated in correspondence or countercorrespondence to light-sensitive silver salts having a latent image distributed imagewise, or a group having a property of releasing Dye in correspondence or countercorrespondence to light-sensitive silver salts having a latent image distributed imagewise, with the diffusibility of dye released being different from that of the compound represented by $(Dye—X)_nY$; and n represents 1 or 2, and when n is 2, the two Dye—X groups can be the same or different.

12. A heat-developable light-sensitive material as in claim 8, wherein the image forming substance is a dye providing substance which reduces exposed light-sensitive silver halide and releases a mobile dye upon reaction with the exposed light-sensitive silver halide by heating.

13. A heat-developable light-sensitive material as in claim 1, wherein an amount of the reducing agent is from 0.01 mol to 20 mols per mol of silver.

14. A heat-developable light-sensitive material as in claim 1, wherein the material further contains a dye releasing assistant.

15. A heat-developable light-sensitive material as in claim 14, wherein the dye releasing assistant is a base or a base precursor.

16. A heat-developable light-sensitive material as in claim 1, wherein the material further contains a development stopping agent.

17. A heat-developable light-sensitive material as in claim 1, wherein the binder is a hydrophilic binder.

18. A heat-developable light-sensitive material as in claim 1, wherein the light-sensitive material comprises a support having thereon at lest three silver halide emulsion layers sensitive to different spectral wavelength regions.

19. A heat-developable light-sensitive material as in claim 18, wherein each of the three silver halide emulsion layers is sensitive to blue light, green light, red light, or infrared light.

20. A heat-developable light-sensitive material as in claim 18, wherein each of the three silver halide emulsion layers contains a yellow, magenta, or cyan-dye-providing substance.

21. A heat-developable light-sensitive material as in claim 1, wherein the binder comprises a hydrophilic colloid.

* * * * *